US005604945A

United States Patent [19]

Fisher et al.

[11] Patent Number: 5,604,945

[45] Date of Patent: Feb. 25, 1997

[54] INFLATABLE MATTRESS

[75] Inventors: David R. Fisher; Hua H. Lin, both of Long Beach, Calif.

[73] Assignee: Intex Recreation Corp., Long Beach, Calif.

[21] Appl. No.: 491,487

[22] Filed: Jun. 16, 1995

[51] Int. Cl.[6] ..... A47C 27/10

[52] U.S. Cl. ..... 5/706; 5/710; 5/711; 441/129

[58] Field of Search ..... 5/449, 455, 456, 5/457; 441/129

[56] References Cited

U.S. PATENT DOCUMENTS

| | | | |
|---|---|---|---|
| D. 273,966 | 5/1984 | Piel . | |
| D. 308,403 | 6/1990 | LaForce, Jr. . | |
| D. 314,804 | 2/1991 | Thomas . | |
| D. 314,805 | 2/1991 | Thomas . | |
| D. 315,774 | 3/1991 | Thomas . | |
| 535,834 | 7/1907 | Ruth . | |
| 1,570,470 | 1/1926 | Fritsche . | |
| 1,576,211 | 3/1926 | O'Kane | 5/455 |
| 2,549,597 | 4/1951 | Harris et al. | 5/457 |
| 2,772,193 | 11/1956 | Ono . | |
| 2,788,533 | 4/1957 | Bornstein . | |
| 2,816,299 | 12/1957 | Holladay | 5/457 X |
| 2,842,783 | 7/1958 | Druck . | |
| 2,939,158 | 6/1960 | Baker | 5/457 |
| 3,056,979 | 10/1962 | Holladay | 5/455 X |
| 3,089,153 | 5/1963 | Bosc . | |
| 3,170,172 | 2/1965 | Kessman . | |
| 3,408,107 | 10/1968 | Savage . | |
| 3,563,837 | 2/1971 | Smith . | |
| 3,688,775 | 9/1972 | Raymann . | |
| 3,701,173 | 10/1972 | Whitney . | |
| 3,835,482 | 9/1974 | Tersch . | |
| 4,136,412 | 1/1979 | Wilhelm | 5/455 X |
| 4,517,693 | 5/1985 | Viesturs . | |
| 4,547,919 | 10/1985 | Wang . | |
| 4,723,329 | 2/1988 | Vaccaro . | |
| 4,756,032 | 7/1988 | Wang . | |
| 4,766,918 | 8/1988 | Odekirk | 441/129 X |
| 4,836,660 | 6/1989 | Greenwood . | |
| 4,891,855 | 1/1990 | Cheng-Chung . | |
| 4,905,322 | 3/1990 | Wang . | |
| 4,964,183 | 10/1990 | LaForce, Jr. . | |
| 5,101,823 | 4/1992 | Smith . | |
| 5,437,068 | 8/1995 | Fisher . | |

FOREIGN PATENT DOCUMENTS 2197192 10/1987 United Kingdom .

OTHER PUBLICATIONS

Zee Toys, Inc. 1983 "The Wet Set Inflatables" Catalog Intex Recreation Corp. 1988 The Wet Set Inflatables Catalog.
Intex Recreation Corp. 1988 "Capture The Fun Sporting Goods" Catalog.
Intex Recreation Corp. 1989 "The Wet Set Inflatables and Swim Gear Line Art" Catalog.
Intex Recreation Corp. 1989 "The Wet Set Inflatables and Swim Gear" Catalog.
Intex Recreation Corp. 1990 "Capture the Fun Sporting Goods" Catalog.
Intex Rereation Corp. 1992 "Capture The Fun Sporting Goods" Catalog.
Intex Crecreation Corp. 1992 "The Wet Set Inflatables and Swim Gear" Catalog.
Intex Recreation Corp. 1994 "Capture The Fun Sporting Goods" Catalog.
Intex Recreation Corp. 1990 "The Wet Set Inflatables and Swin Gear Catalog".

(List continued on next page.)

*Primary Examiner*—Michael F. Trettel
*Attorney, Agent, or Firm*—David N. Makous; John S. Christopher

[57] ABSTRACT

An inflatable mattress comprising a pair of exterior tubes longitudinally disposed in parallel on opposite sides of the mattress in combination with a plurality of parallel connected interior tubes smaller in diameter then the exterior tubes and in sufficient number and dimension to partially enwrap a human user reclining on the inflated mattress.

7 Claims, 4 Drawing Sheets

OTHER PUBLICATIONS

Intex Recreation Corp. 1991 "Capture The Fun Sporting Goods" Catalog.

Intex Recreation Corp. 1991 "The Wet Set Inflatables and Swim Gear Catalog".

Intex Recreation Corp. 1995 "The Sport Set Sporting Goods" Catalog.

Intex Recreation Corp. 1995 "The Wet Set Pool, Inflatables and Swim Gear" Catalog.

INFLATABLE MATTRESS

BACKGROUND OF THE INVENTION

In traditional air mattress construction, inflatable tubes or chambers are arranged longitudinally and are substantially uniform in dimension. When inflated the traditional air mattress provides a surface structure which does not readily conform to the reclining users body shape, or otherwise maintain stability when placed in use, often shifting and becoming entangled with the user. Other configurations do little to provide stability for use in water and on land.

The present invention provides an inflatable air mattress which partially envelops or enwraps the user while in use, and which will support the user and reduce the tendency for a user to slide or roll off the mattress surface. It also provides an air mattress structure which has sections which are inflatable to differing dimensions for use on uneven land surfaces, creating a stable and reclining level surface for the user, such as for outdoor camping.

SUMMARY OF THE INVENTION

The invention comprises a pair of parallel exterior tubes, and connected interior tubes disposed between the exterior tubes, such that when all are inflated a reclining user will be partially enwrapped by the mattress. The invention also comprises tubes which may be constructed in part by either I-beam or X-beam seal structures. The invention also comprises the use of a pillow tube. The invention also comprises exterior tubes which may be inflated independently of each other and any interior tube or pillow tube. The invention also comprises a pneumatic system wherein communication between the interior and exterior tubes is through a common manifold portion.

DETAILED DESCRIPTION

Figure 1:
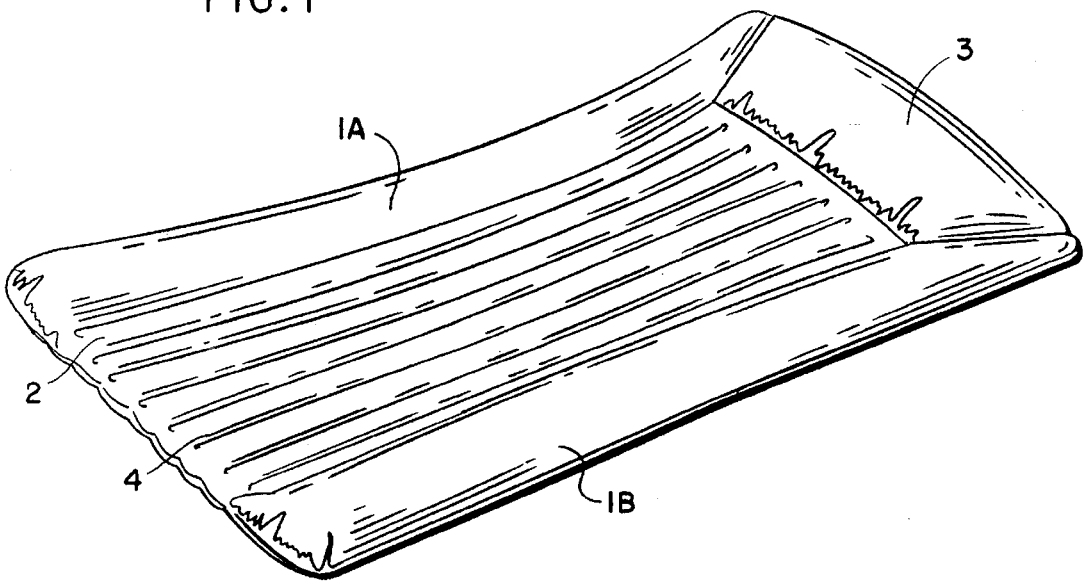
FIG. 1 is a perspective view of the inflatable mattress according to the invention.
Figure 2:
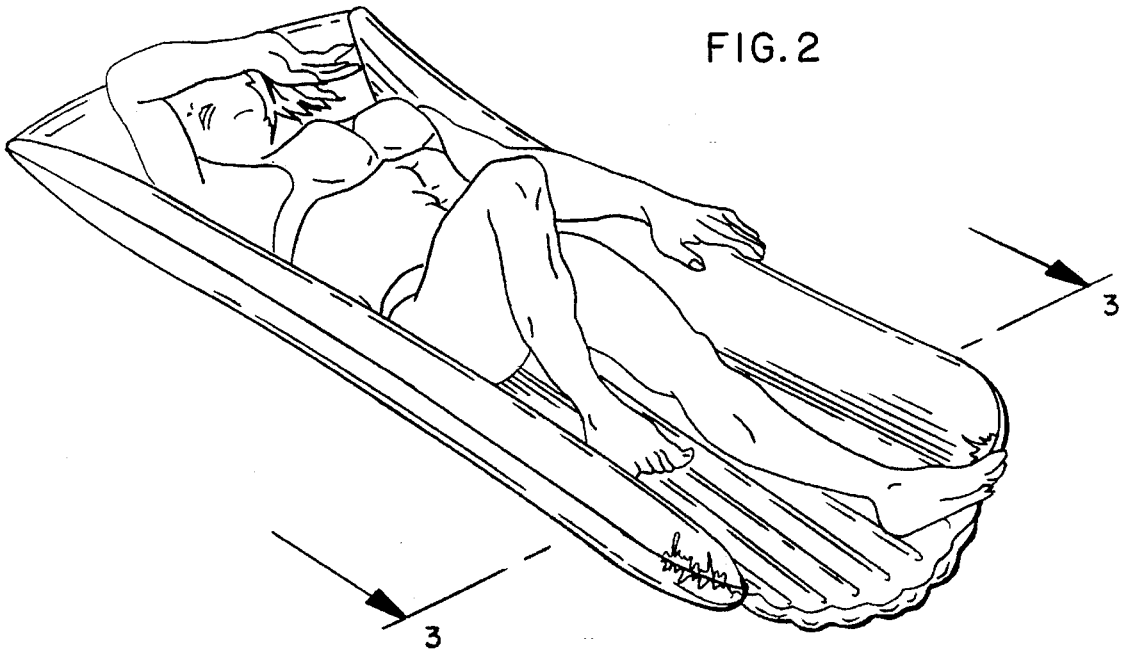
FIG. 2 is a view of the mattress of FIG. 1 when a user is reclining thereon in water.
Figure 5:
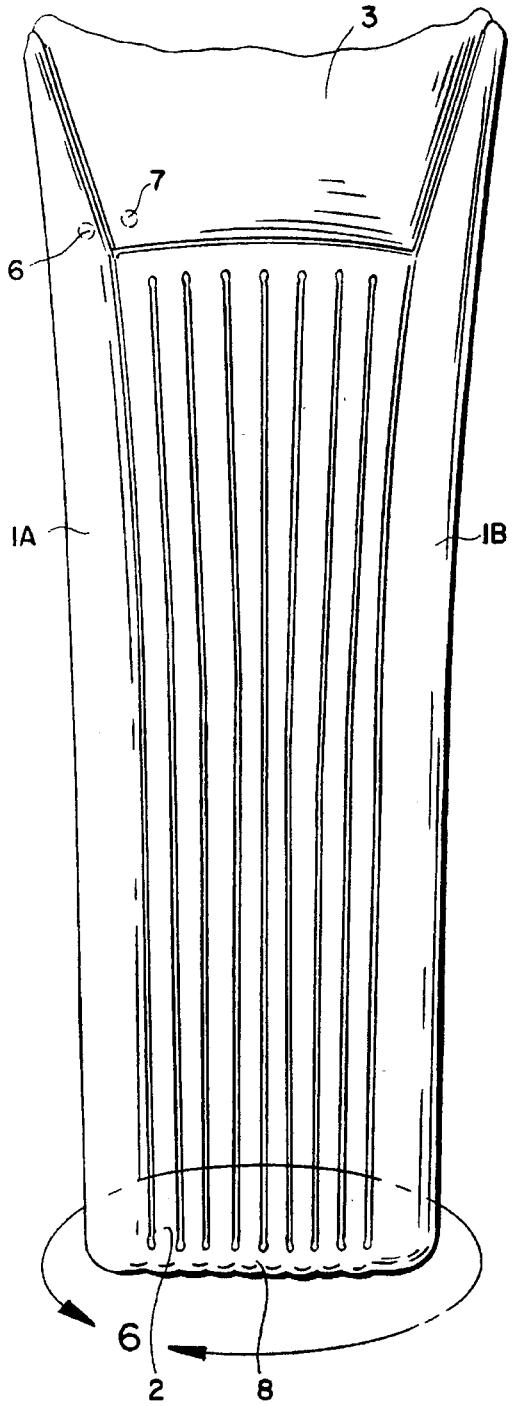
FIG. 5 is a plan view of an inflatable mattress according to the invention.

For a detailed description of the invention reference is made to the various figures. FIGS. 1 and 5 generally display a representation of the preferred embodiment of the invention. The inflatable mattress is comprised of a pair of exterior tubes 1A and 1B, longitudinally disposed in parallel on opposite sides of the periphery of the mattress. Between these exterior tubes are eight parallel interior tubes 2, sealed in series from one exterior tube to the other, each connected at a seam 4. There also is a pillow portion 3.

FIG. 5 displays a pair of valves 6, 7. Valve 6 provides for inflation of the two exterior tubes 1A, 1B and all interior tubes 2. Valve 7 provides for inflation of the pillow tube 3. When inflating the mattress, air moves in through valve 6 and proceeds generally within exterior tube 1A, moves through the common manifold portion 8 within the foot of the air mattress eventually inflating all of the interior tubes 2, and within the opposite exterior tube 1B. When inflating the pillow portion, air moves through the valve 7 until the entire pillow portion 3 is inflated to the desired level.

In the preferred embodiment, the dimensions of the inflatable mattress are designed for use by an average size adult on land or in water. The mattress material is comprised of multiple sheets of plastic which are sealed at the appropriate seam locations 4 to create separate tubes or air chambers in each desired location. Each interior tube 2 is of substantially smaller diameter than the pair of exterior tubes 1. One advantage of this construction is that all of the longitudinally positioned tubes, exterior and interior, are interconnected by a common manifold 8 for inflation purposes without loss of comfort.

The interior tubes are about 1.7 inches in diameter. The exterior tubes are about 4.25 inches in diameter. This disparity in diameters enhances the requisite "wrap around" flexibility of the tubes to create the envelope effect when in use, particularly in water, while the differential in diameters between the interior and exterior tubes also provides stability at each side of the mattress when in use.

In the preferred embodiment the air mattress is about 72 inches in length. The pillow portion is preferably 13 inches in length. The total air mattress width is about 22 inches. All dimensions represented are for the mattress when inflated. The valves can be placed in a suitable location to accomplish inflation in accordance with the preceding parameters.

Figure 3:
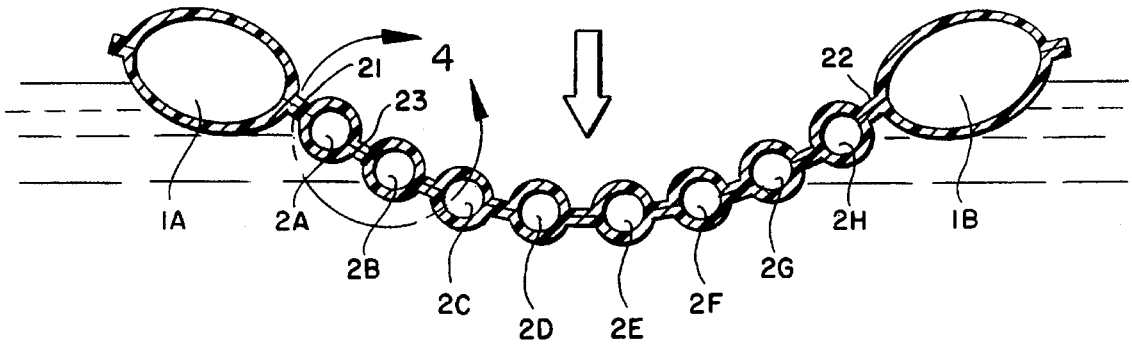
FIG. 3 is a transverse cross-section of the mattress of FIG. 2 taken along line 3—3.
Figure 4:
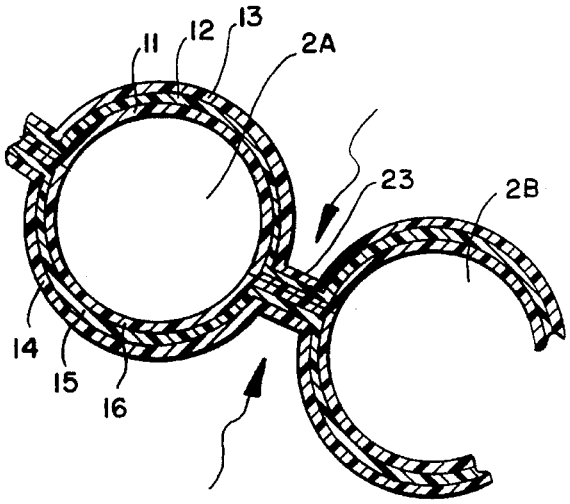
FIG. 4 is an enlarged fragmentary view of a portion of FIG. 3, taken within arc 4.

FIGS. 3 and 4 illustrate the internal construction of the preferred embodiment. FIG. 3 shows the interior tubes 2A through 2H. Each of the interior tubes is connected by an X-beam heatsealing structure as illustrated in FIG. 4. As can be seen in FIG. 4 each tube has multiple layers 11, 12, 13, and 14, 15, 16 of laminated pvc plastic disposed on opposite sides of the tube 2A. These layers are laminated together by heat sealing at juncture 23 in the layered fashion indicated, resulting in each pneumatically sealed tube.

The outer most interior tubes (2A, 2H) are joined by heat seal to the exterior tubes 1A, 1B, respectively, at junctures 21, 22, respectively.

Figure 6:
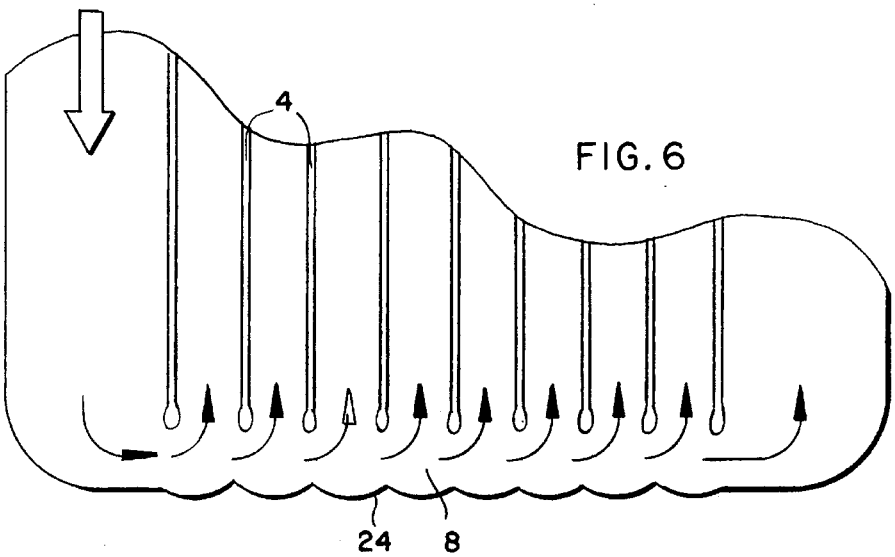
FIG. 6 is an enlarged fragmentary view of FIG. 5 taken within arc 6.

In the preferred embodiment the interior and exterior tubes share a common manifold portion 8, which is illustrated in enlarged detail in FIG. 6, at the distal end of the mattress. At the termination of each heat seal seam or wall 4 is an open area or manifold sufficient for air to communicate from the exterior tube 1A within the distal wall 24 of the mattress to the interior tubes 2 and opposite exterior tube 1B, as indicated by the arrows in FIG. 6.

Figure 7:
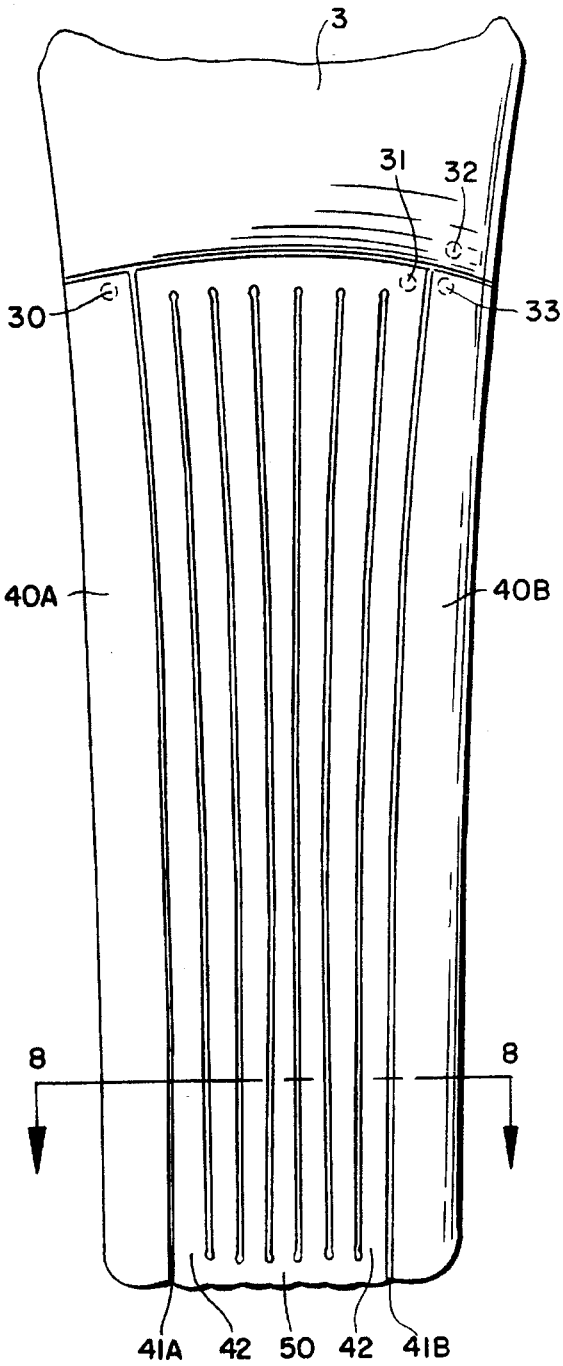
FIG. 7 is a plan view of another embodiment of the inflatable mattress.
Figure 8:
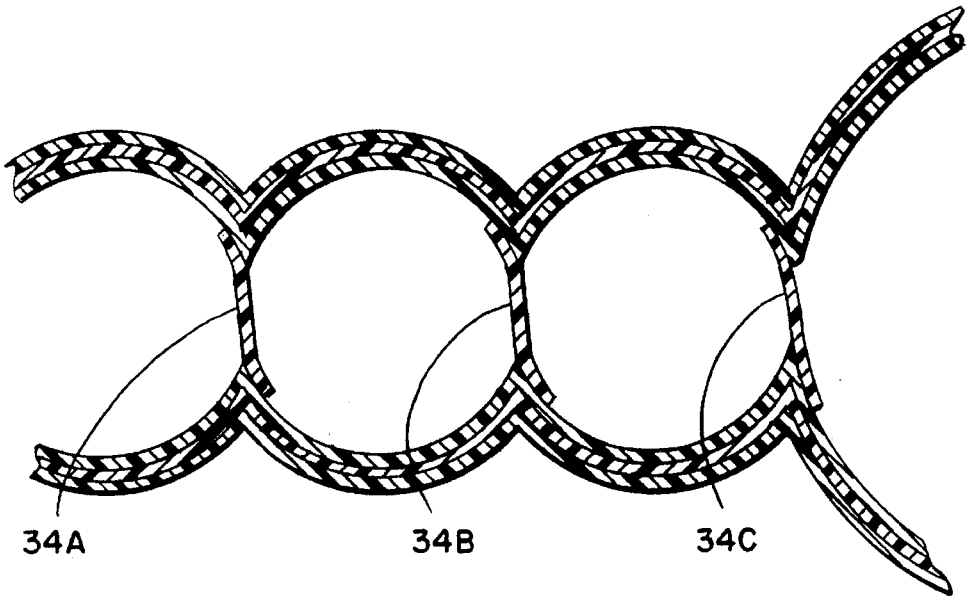
FIG. 8 is an enlarged fragmentary transverse cross-section taken at line 8—8 of FIG. 7.
Figure 9:
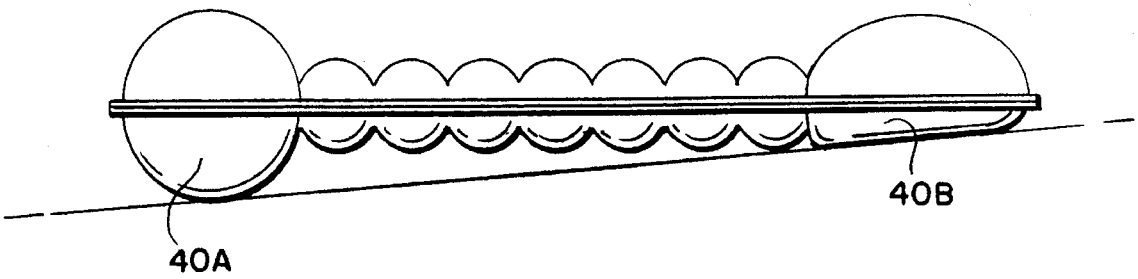
FIG. 9 is an illustration of the bottom view of the mattress of FIG. 7 on solid ground when the exterior tubes are inflated to different pressures.

Another embodiment has particular suitability for use on ground surfaces, and is useful as a sleeping mattress while camping outdoors. As illustrated in FIGS. 7 through 9 there are multiple valves 30–33 and I-beams or baffles 34A, 34B and 34C. The I-beam construction is conventional and is created by suitable heat sealing methods. The I-beam or baffles 34A, 34B and 34C operate to create a more rigid mattress surface when inflated and in use. The valves 30, 31, 32 and 33 each allow for inflation of different tube sections.

In FIG. 7 the exterior tubes 40A, 40B are inflated independently of any other tube through valves 30 and 33, respectively. The walls 41A, 41B isolate and separate each of the exterior tubes from the adjacent interior tubes 42. Consequently, inflation of an exterior tube will not cause the inflation of any other tube. Valve 31 allows for inflation of all of the interior tubes 42 within a common manifold area 50 connecting all of the interior tubes. Valve 32 is the inflation entry port for the pillow tube 3. A separately inflatable pillow provides a means for an adjustable headrest.

In this embodiment, the exterior tubes are about 4 inches in diameter and about 14 inches apart, which in turn creates a proportionally wider pillow section then that illustrated in the prior embodiment. The interior tubes are about 2 inches each in diameter. The length of the mattress is about 76 inches. All dimensions are for an inflated mattress.

One advantage of this structure is illustrated in FIG. 9. In many applications the ground area is not level and it is desirable that the air mattress be suitably adjustable so that the user will recline on a level mattress surface. This is accomplished by inflating one of the exterior tubes 40A to a greater extent than the other exterior tube 40B, as illustrated in FIG. 9, which schematically represents the resultant creation of a level reclining environment.

It can be useful to laminate an exterior fabric to the plastic to improve the comfort level of the inflatable mattress used outdoors. Fabrics such as cotton, rayon, and nylon can be used. Cotton and rayon are superior to nylon in many applications because they provide greater friction or gripping.

While the above embodiments are comprised of multilayered laminates, in other embodiments a single layer of material may be used for the mattress.

We claim:

1. An inflatable mattress for use on solid and fluid surfaces comprising:

(a) a pair of exterior tubes, longitudinally disposed in parallel on opposite sides of the periphery of the mattress, said pair of external tubes having tapering edges;

(b) a plurality of parallel, connected interior tubes formed of multiple PVC layers, said plurality of interior tubes being smaller in diameter than the pair of exterior tubes and disposed in series between the exterior tubes, said plurality of interior tubes being of sufficient numbers and dimension to partially enwrap, when inflated, a human user reclining longitudinally thereon when the mattress is in use;

(c) multiple valve means to inflate each of said tubes through a common air manifold; and (d) pillow tube for communicating with each of said tubes.

2. An inflatable mattress as in claim 1 wherein at least one tube is connected to an adjacent tube by an x-beam seal structure.

3. The inflatable mattress of claim 1 further including means for inflating said pillow tube.

4. The inflatable mattress of claim 1 wherein each of said plurality of interior tubes is separated from an adjacent interior tube by a longitudinal seam.

5. An inflatable mattress for use on solid and fluid surfaces comprising:

(a) a pair of exterior tubes, longitudinally disposed in parallel on opposite sides of the periphery of the mattress, said pair of external tubes having tapering edges;

(b) a plurality of parallel, connected interior tubes formed of multiple PVC layers, said plurality of interior tubes being smaller in diameter than the pair of exterior tubes and disposed in series between the exterior tubes, wherein each of said pair of external tubes and said plurality of interior tubes being formed of an I-beam seal structure, and said pair of exterior tubes being independently inflatable to enable use of said inflatable mattress on a non-level surface by adjusting the inflation pressure in each of said pair of exterior tubes;

(c) multiple valve means to inflate each of said pair of exterior tubes and said plurality of interior tubes wherein said interior tubes being inflated through a common air manifold; and (d) a pillow tube for communicating with each of said tubes.

6. The inflatable mattress of claim 5 further including means for inflating said pillow tube.

7. The inflatable mattress of claim 5 wherein each of said plurality of interior tubes is separated from an adjacent interior tube by a longitudinal seam.

* * * * *